US006215400B1

(12) United States Patent
Rand et al.

(10) Patent No.: US 6,215,400 B1
(45) Date of Patent: Apr. 10, 2001

(54) ELECTRONIC SECURITY TAG SYSTEM

(75) Inventors: Richard Rand, East Northport; Joseph Deconinck, West Babylon, both of NY (US)

(73) Assignee: Protex International Corp., Bohemia, NY (US)

( * ) Notice: Subject to any disclaimer, the term of this patent is extended or adjusted under 35 U.S.C. 154(b) by 0 days.

(21) Appl. No.: 09/432,868

(22) Filed: Nov. 2, 1999

(51) Int. Cl.[7] ..... G08B 13/14
(52) U.S. Cl. ..... 340/568.2; 340/568.8
(58) Field of Search ..... 340/568.2, 568.8

(56) References Cited

U.S. PATENT DOCUMENTS 4,000,488 12/1976 Ephraim ..... 340/568.2
5,146,205 * 9/1992 Keifer et al. ..... 340/568.2
5,172,098 * 12/1992 Leyden et al. ..... 340/568.2
5,699,591 12/1997 Kane ..... 24/304
5,821,857 10/1998 Rand ..... 340/568.8
5,936,525 * 8/1999 Leyden et al. ..... 340/568.2

* cited by examiner

*Primary Examiner*—Thomas Mullen
(74) *Attorney, Agent, or Firm*—Collard & Roe, P.C.

(57) ABSTRACT

An electronic security tag system comprising a security anchor having an aperture therethrough and a plurality of flexible wings extending outward. There is an adhesive layer attached to the bottom surface of the anchor for adhering the anchor to the article. A security wire is threaded through the aperture in the anchor and is held securely within the aperture of the anchor. A PC board having a diode is connected to an end of the security wire threaded through the aperture. A flexible adhesive tag is connected to the PC board. The tag has a circuit wired therethrough which is connected via the PC board to the diode. The security wire is connected to an electronic security monitoring system having an audible alarm. Cutting the security wire or the circuit in the tag triggers the alarm.

11 Claims, 5 Drawing Sheets

ELECTRONIC SECURITY TAG SYSTEM

BACKGROUND OF THE INVENTION

1. Field of the Invention

This invention relates to an electronic security tag system for preventing the theft of portable articles such as consumer electronics. In particular, this invention relates to an electronic security tag system having an adhesive electronic tag affixed to an article to be monitored and connected to an electronic monitoring system that sounds an alarm if the tag is broken or disconnected from the system.

2. The Prior Art

It is known to protect articles against theft by attaching an anchor to the article and attaching one end of a cable or cord to the anchor. The other end of the cable or cord is attached to a fixed support so that the article can only be moved a limited distance from the fixed support. The anchor is usually plastic and has an adhesive backing layer to attach the anchor to the article. The adhesive is strong enough so that a thief cannot readily peel the anchor from the article to detach the cable from the article. If the anchor cannot be readily peeled away from the article within 30–60 seconds, then this deters most thieves from trying to remove the anchor and steal the article.

The problem with this type of system is that a thief can still easily steal the article by cutting the cord attached to the anchor. An electronic sensor system connected to an anchor is shown in U.S. patent application Ser. No. 09/378,040 to Rand et al. This system has a hexagonal anchor attached via a wire to an electronic alarm system. If the anchor is removed or the wire is cut, an alarm sounds from the alarm system. The alarm system is shown in U.S. Pat. No. 5,821,857 to Rand, the disclosure of which is herein incorporated by reference.

While this system is effective for protecting larger items having irregular surfaces, it would be desirable to have an electronic security monitoring system of this type in which the sensor part of the mechanism can be wrapped around the article to be monitored. In addition, it would be desirable to have a system that could prevent not only theft of the item but also prevent thieves or vandals from opening certain items such as cameras.

SUMMARY OF THE INVENTION

It is therefore an object of the present invention to provide an electronic security system that can be adhered to both flat and curved surfaces.

It is another object of the present invention to provide an electronic security system that sounds an alarm if any part of the system tampered with.

It is yet another object of the present invention to provide an electronic security system that can be used to secure items having curved or compound surfaces, or to protect multiple locations on the same product.

It is a further object of the invention to provide an electronic security system that can prevent the opening or tampering with the item to be monitored.

It is another object of the present invention to provide a security anchoring system that is simple to manufacture and easy to install.

These and other objects of the invention are accomplished by an electronic security tag system comprising a security anchor having an aperture therethrough. A security wire is threaded through the aperture in the anchor and is held securely within the aperture. A PC Board (PCB) assembly, which includes a presence detection diode and means for connecting a security tag, is connected to an end of the security wire threaded through the aperture. An adhesive electronic tag is connected to the PCB and diode through the other end of the anchor. The tag is flexible and can be wrapped around items of contoured shape or used to seal an item closed. The tag contains circuitry which is in contact with the diode so that any breaking of the circuit in the tag will be detected. The tag can be any suitable electronic security tag, such as that shown in U.S. Pat. No. 4,000,488 to Ephraim, the disclosure of which is herein incorporated by reference. This tag is a bendable sheet having an electric circuit thereon. The circuit comprises a closed loop. The tag is coated with an adhesive covered by a protective sheet which is removed when the tag is placed on the object to be monitored. The tag also incorporates conductive connection pads at one end for attachment to the rest of the system. The tag is preferably attached to the PCB and diode using friction. A rubber insert holds the tag's connection pads in contact with the PCB.

The anchor preferably comprises a plurality of flexible wings surrounding the aperture. Each wing is separated by a wing slot. One wing slot communicates with the aperture. There is a hinge area for each wing located between the adjacent pair of wing slots to allow one wing to flex independently of another wing. A suitable anchor is disclosed in U.S. patent application Ser. No. 09/378,040 to Rand et al., or in U.S. Pat. No. 5,699,591 to Kane, the disclosures of which are herein incorporated by reference.

There is an electronic alarm system connected to an end of the wire not threaded through the aperture, which sounds an alarm when the circuit in the tag is broken or if the wire is cut. This way, the alarm will sound if a thief attempts to steal or tamper with the article either by cutting the wire or by prying off or cutting the tag. The diode monitors the status of the tag and indicates the presence of the electronic tag system to the alarm system. The electronic alarm system can be any type of system that can monitor several different items and sound an alarm if any of the items is stolen, such as that disclosed in U.S. Pat. No. 5,821,857 to Rand, the disclosure of which is herein incorporated by reference.

The wire is optionally coated with a flexible sheath made of an elastomeric material.

The wire is preferably maintained in the aperture by an assembly comprising an upwardly extending wall surrounding the aperture on the anchor and having a slit along one side. The slit extends out to the edge of the anchor to allow the wire to be inserted in the aperture through the slit. There is an enclosure surrounding the diode. The enclosure has a lower portion extending through the aperture and disposed within the wall, and an upper bifurcated portion extending beyond the wall. A retainer cone surrounds the wire, above the wall. The retainer cone has an internal circumference slightly smaller than the circumference of the bifurcated portion of the enclosure, so that sliding the retainer cone over the enclosure squeezes the enclosure inward and holds the wire within the anchor. The lower portion of the enclosure has a longitudinally extending protrusion that fits within the slit in the wall to fill in the gap created by the slit and give added mechanical rigidity.

A bi-color LED may be mounted on the enclosure and connected to the security wire and diode to indicate the status of the system. One color, i.e., green, indicates that the tag and anchor are mounted and secure on a product. The other color, i.e., red, indicates that the tag or wire has been tampered with and indicates an alarm condition.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
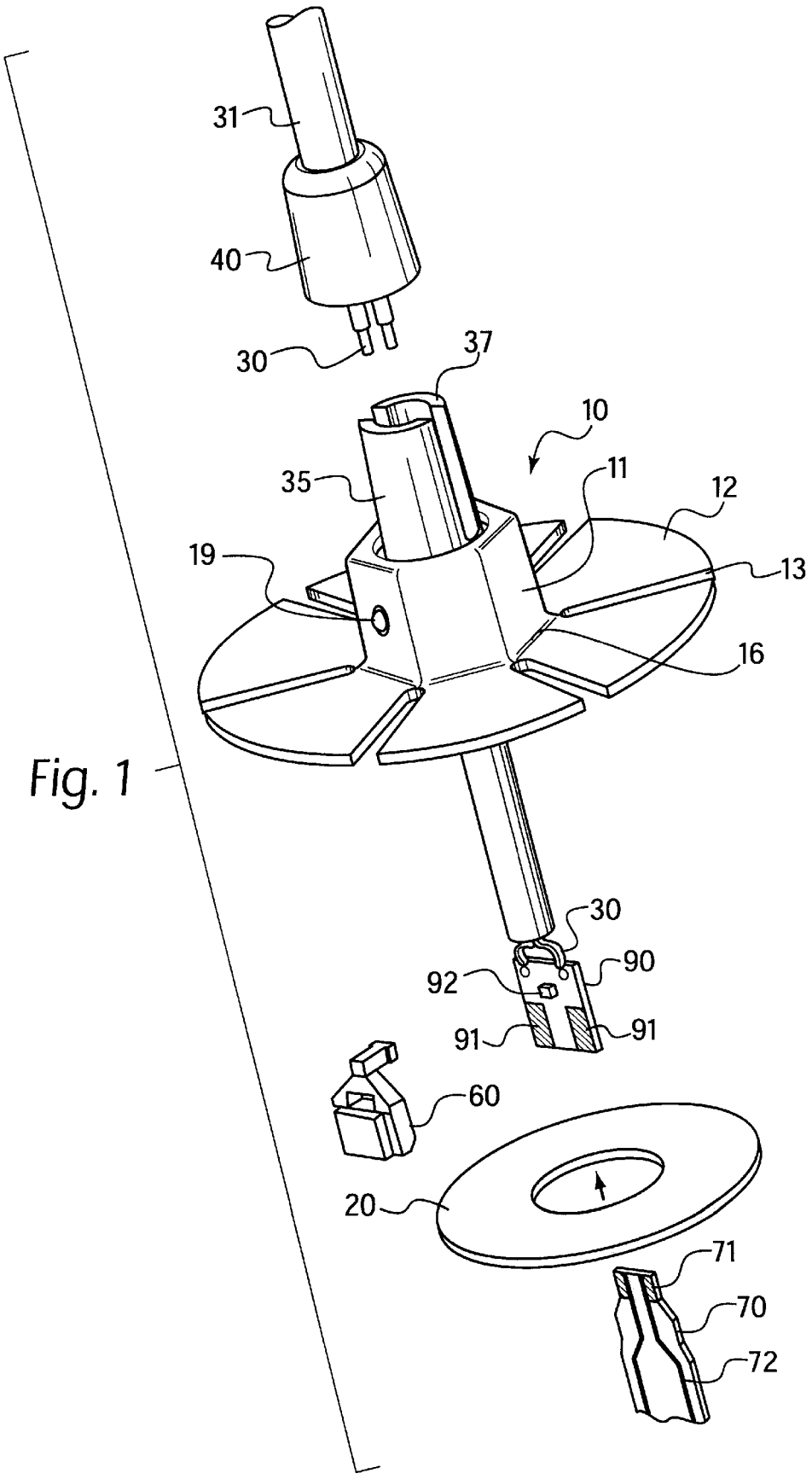
FIG. 1 shows an exploded view looking from the top of the electronic tag system according to the invention.
Figure 2:
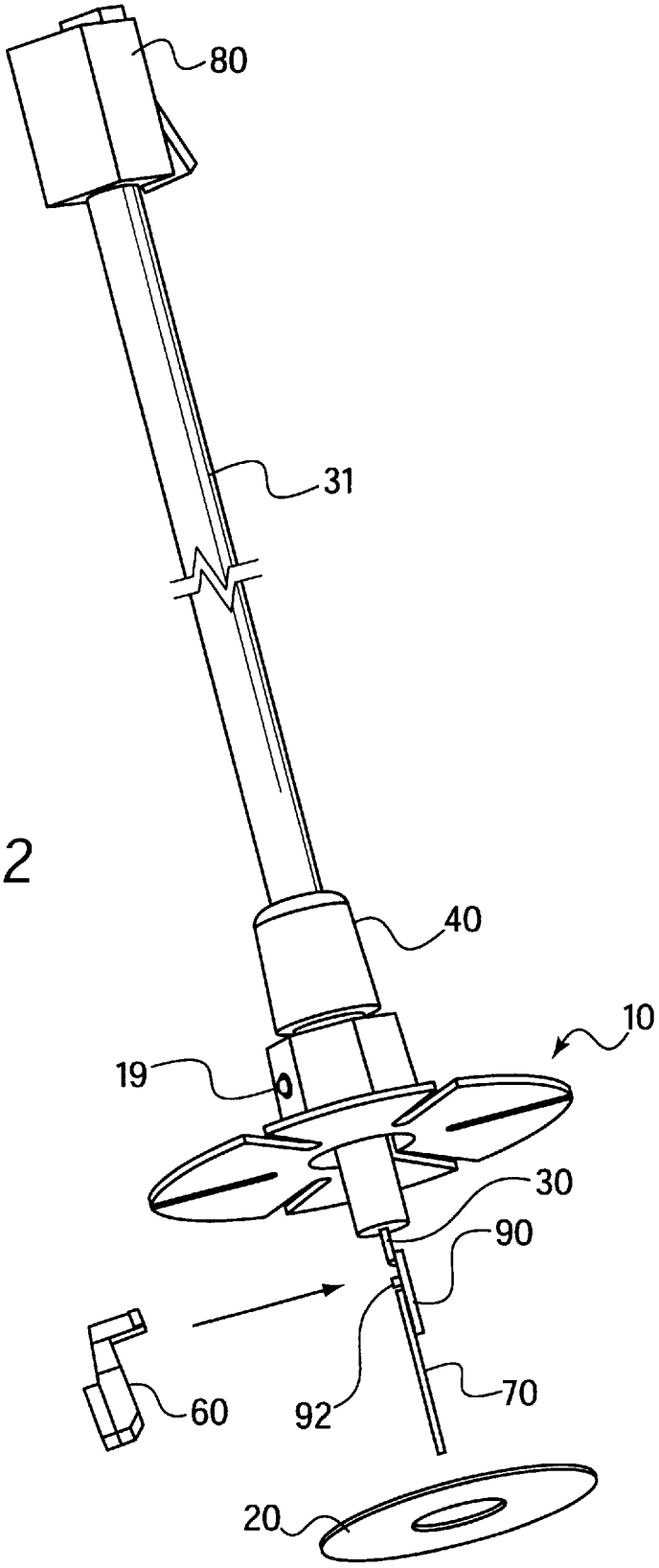
FIG. 2 shows a perspective view of the electronic tag system as assembled.
Figure 4:
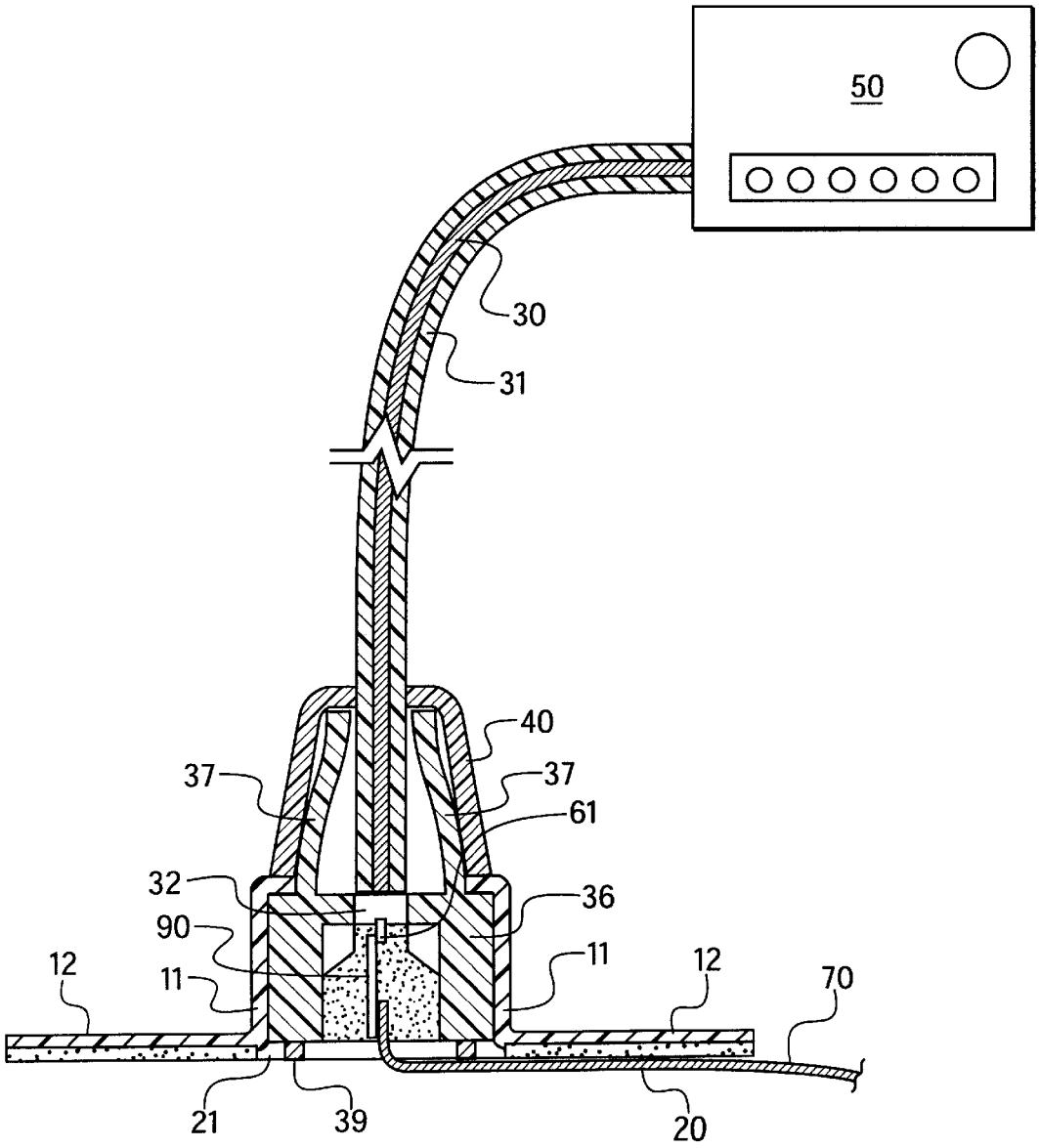
FIG. 4 shows a side cross-sectional view of the electronic tag system according to the invention.

Referring now in detail to the drawings and, in particular, FIGS. 1 and 2 there is shown the security tag system according to the invention. The system comprises an anchor 10, having wings 12 separated by wing slots 13 and a wall portion 11, and an enclosure 35. There is a hinge area 16 for each wing 12 located between an adjacent pair of wing slots 13 to allow one wing to flex independently of another wing. Anchor 10 is connected to a security wire 30 via enclosure 35. Wire 30 is encased in an elastomeric coating 31. A retainer cone 40 is slid down over enclosure 35 to keep the assembly together, as explained in further detail below. The other end of security wire 30 is connected to a telephone modular plug connector 80, which is then connected to a security alarm system 50, which is shown in FIG. 4.

A PC Board (PCB) 90 is connected at one end to wire 30. PCB has a diode 92 and electronic contact pads 91. An adhesive electronic tag 70 is inserted into the anchor and is connected to PCB 90 via friction. Tag 70 has electronic contact pads 71 and electrically conductive ink 72, which create a closed circuit when tag 70 is connected to PCB 90. Contact pads 71 of tag 70 touch contact pads 91 of PCB 90 when tag 70 is inserted next to PCB 90 within anchor 10. Tag 70 is kept in place next to PCB 90 in anchor 10 by a rubber connector 60 that fits within enclosure 35. Conductive ink 72 creates a closed circuit when tag 70 is connected to wire 30 via PCB 90. The circuit is broken any time tag 70 is tampered with, such as by attempts to pry tag 70 off of the article to which it is attached. This triggers the alarm and alerts store personnel of an attempted theft. In addition, there is an LED 19 connected to wire 31 and diode 92. LED 19 glows one color when the wire and circuit are intact and glows another color when the wire or circuit is cut.

Figure 3:
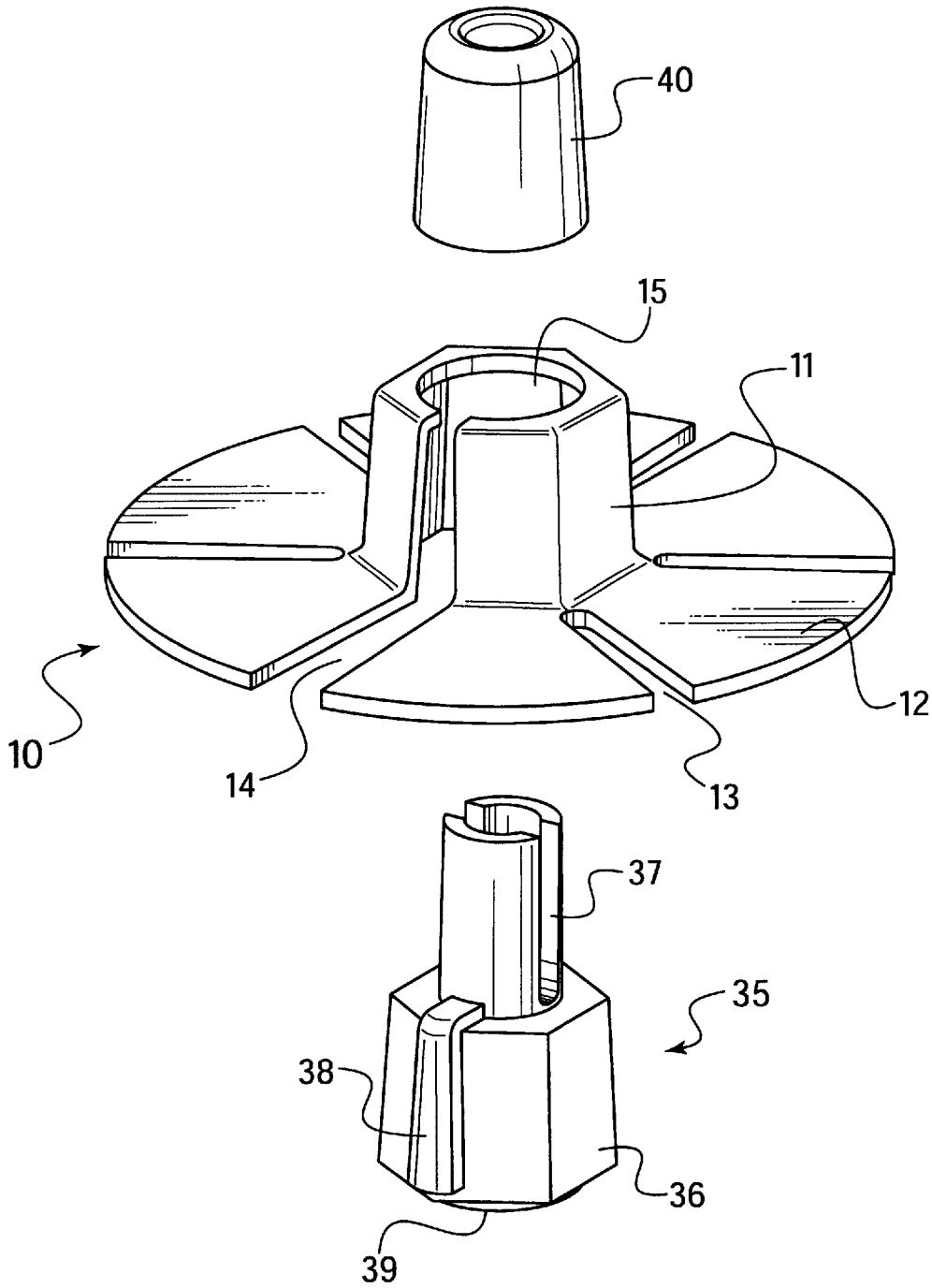
FIG. 3 shows an exploded view of the anchoring system according to the invention.

As shown in FIG. 3, anchor 10 consists of a wall portion 11 and a plurality of wings 12 separated by wing slots 13. Wall portion 11 has an aperture 15 extending therethrough and a slit 14 to allow the insertion of wire 30.

An adhesive pad 20 is affixed to the bottom of anchor 10. Adhesive pad 20 has double-sided adhesive so that it adheres to both anchor 10 and the surface of an article (not shown). Adhesive pad 20 has a center hole 21 therethrough. Aperture 21 is larger than ledge 39 of enclosure 35.

As shown in FIGS. 3 and 4, wire 30 is retained in place within aperture 15 by enclosure 35, which consists of a hexagonal lower portion 36 and a bifurcated upper portion 37. Hexagonal lower portion 36 fits snugly within wall portion 11 of anchor 10 and keeps the end of wire 30 from pulling out of anchor 10. Lower portion 36 has a longitudinal protrusion 38 that fits within slit 14.

Retainer cap 40 is slid down wire 30 and placed over bifurcated upper portion 37 to hold wire 30 in place. As shown in FIG. 4, retainer cap 40 squeezes bifurcated upper portion 37 inward to securely grip wire 30 in between. Cap 40 thus has an inner diameter that is smaller than the diameter of bifurcated upper portion 37.

This arrangement keeps wire 30 with PCB 90 and diode 92 securely retained within anchor 10. As shown in FIGS. 3 and 4, enclosure 35 has a protruding ring-shaped ledge 39 disposed on its bottom surface. Ledge 39 fits into center hole 21 of adhesive pad 20. As shown in FIG. 4, ledge 39 extends only partially into center hole 21, so as not to disrupt the seal between adhesive pad 20 and the article to be secured. Ledge 39 prevents a thief from prying enclosure 35 and thus anchor 10 away from adhesive pad 20 to steal the secured article. A knife inserted between enclosure 35 and adhesive pad 20 will be stopped by ledge 39 before it can be inserted sufficiently to remove anchor 10 from adhesive pad 20.

As shown in FIG. 4, wire 30 is connected to a central alarm control box 50, which sends an audible alarm throughout the premises if the anchoring system is tampered with. The system works as follows: After the system is assembled as shown in FIG. 4, tag 70 is applied to a section of an article to be secured. Anchor 10 is then mounted to the article as well. Tag 70 is typically used to seal a portion of the article that could be opened or removed. Anchor 10 provides additional security to the article by preventing a thief from easily ripping tag 70 off of the article.

The alarm in control box 50 will be triggered if the tag is tampered with to disrupt the circuit within the tag or if any one of the wires 30 are cut or disconnected. Several security anchoring systems may be connected to a single control box 50, which can monitor multiple articles.

Figure 5:
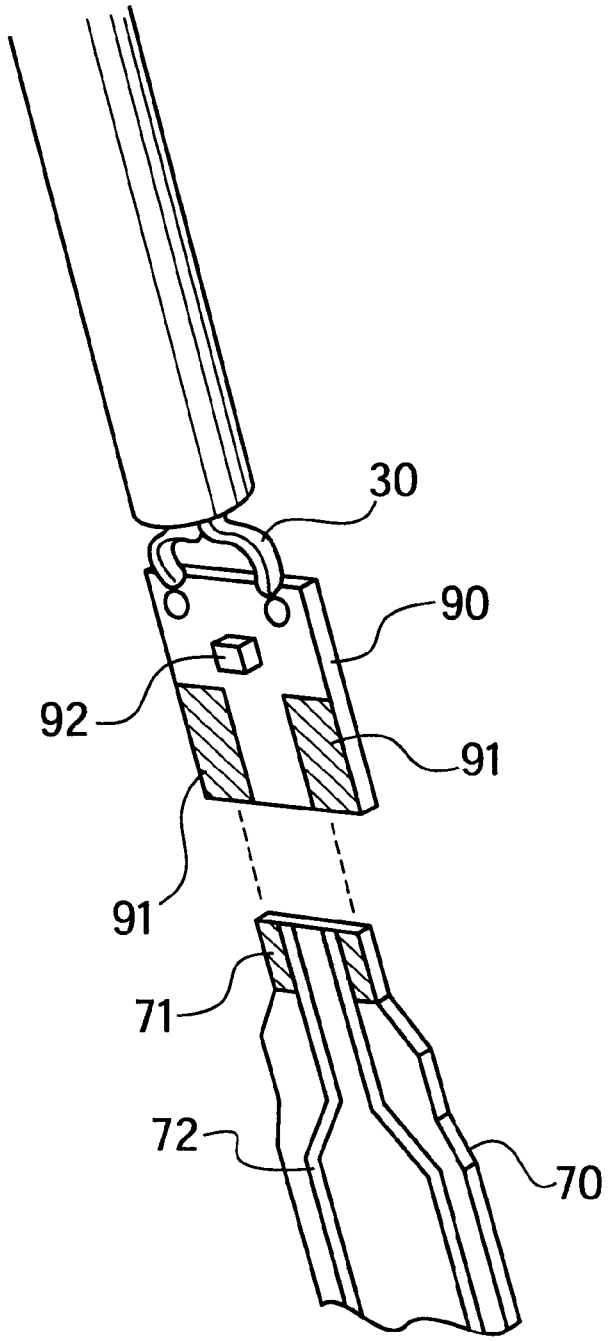
FIG. 5 is a top view of the security tag and PCB according to the invention.

FIG. 5 shows a top view of the tag 70 and PCB 90 according to the invention. Tag 70 has electrically conductive ink 72 connected via electric contact pads 71 to electric contact pads 91 of PCB 90 when tag 70 and PCB 90 are inserted into anchor 10.

Accordingly, while only one embodiment of the present invention has been shown and described, it is obvious that many changes and modifications may be made thereunto without departing from the spirit and scope of the invention.

What is claimed is:

1. A electronic tag system for connection to a monitoring system having an alarm for preventing theft of an article, comprising:

a security anchor having an aperture therethrough, said anchor having a top surface and a bottom surface; and an adhesive layer attached to said bottom surface for adhering said anchor to the article;

a security wire having an end threaded through said aperture in said anchor;

means for maintaining said security wire in said aperture;

a PC board (PCB) containing a diode connected to said end of said security wire;

a flexible adhesive tag electrically connected to said PCB and diode, said tag having an electronic circuit thereon, wherein disconnecting either the circuit in the tag or the security wire triggers the alarm.

2. The electronic tag system according to claim 1, wherein said anchor further comprises:

a plurality of circumferential wings separated by wing slots surrounding said aperture, one wing slot communicating with the aperture; and a hinge area for each wing located between an adjacent pair of wing slots to allow one wing to flex independently of another wing.

3. The electronic tag system according to claim 2, wherein there are six wings.

4. The electronic tag system according to claim 1, wherein said wire is coated with a flexible sheath.

5. The electronic tag system according to claim 1, wherein said means for maintaining the wire in the aperture comprises:

an upwardly extending wall surrounding said aperture on said anchor, said wall having a slit along one side, said slit extending out to the edge of the anchor to allow said wire to be inserted in said aperture through said slit;

an enclosure surrounding said diode, said enclosure having lower portion extending through said aperture and disposed within said wall, and an upper bifurcated portion extending beyond said wall; and a retainer cone surrounding said wire and being slidable thereon, said retainer cone having an internal circumference slightly smaller than the circumference of the bifurcated portion of said enclosure, such that sliding said retainer cone over said enclosure squeezes said enclosure inward and holds said wire within said anchor.

6. The electronic tag system according to claim 5, wherein the lower portion of said enclosure has a longitudinally extending protrusion that fits within said slit in said wall.

7. The electronic tag system according to claim 5, wherein said aperture and wall are hexagonal in shape.

8. The electronic tag system according to claim 5, wherein said adhesive layer has an aperture extending therethrough and further comprising a ring-shaped ledge mounted on a bottom end of said enclosure, said ring shaped ledge extending partially into said aperture in said adhesive layer.

9. The electronic tag system according to claim 1, further comprising a resilient connecting element connected to said PCB and tag, said resilient connecting element fitting within said enclosure and connecting said tag to said PCB.

10. The electronic tag system according to claim 1, further comprising an LED connected to said wire and diode, said LED glowing one color when said wire and circuit are intact and glowing another color if said wire or circuit is cut.

11. The electronic tag system according to claim 1, wherein said tag has electric contact pads disposed thereon, said pads being electrically connected to said circuit in the tag, and wherein said PCB has electric contact pads disposed thereon, and wherein said pads on said tag contact said pads on said PCB to connect said tag to said PCB.

* * * * *